United States Patent [19]

Heinrich et al.

[11] Patent Number: 4,538,036

[45] Date of Patent: Aug. 27, 1985

[54] ELECTRICAL SWITCHING APPARATUS

[75] Inventors: Andrew L. Heinrich, Peoria; Richard L. Oljace, Washington, both of Ill.

[73] Assignee: Caterpillar Tractor Co., Peoria, Ill.

[21] Appl. No.: 648,232

[22] Filed: May 18, 1982

[51] Int. Cl.[3] ..... H01H 19/54

[52] U.S. Cl. ..... 200/11 EA

[58] Field of Search ..... 200/11 R, 11 A, 11 C, 200/11 E, 11 EA, 11 J, 11 K, 11 TW, 155 R, 17 R, 52 R, 61.5

[56] References Cited

U.S. PATENT DOCUMENTS

| | | | |
|---|---|---|---|
| 2,531,764 | 11/1950 | Binus et al. | 200/11 EA |
| 2,762,876 | 9/1956 | Glogau et al. | 200/11 EA |
| 3,337,699 | 8/1967 | Miller | 200/11 EA |
| 3,596,013 | 7/1971 | Pihl | 200/11 EA |
| 3,944,761 | 3/1976 | Nicholl et al. | 200/11 EA |
| 4,042,759 | 8/1977 | Cella | 429/121 |
| 4,176,284 | 11/1979 | Higgs | 307/10 BP |
| 4,306,126 | 12/1981 | Howard | 200/52 R |

*Primary Examiner*—J. R. Scott

*Attorney, Agent, or Firm*—Stephen L. Noe

[57] ABSTRACT

An electrical switching apparatus (10) for use as a battery disconnect device in a vehicle reduces sparking resulting from the switching of electrical currents by controlling the rate at which such switching occurs with a cam (22) and follower (20) arrangement.

The apparatus (10) includes a housing (12) having a cam (22) and a shaft (18) having a follower (20). The shaft (18) extends through the housing (12), and through a movable contact (14). The cam (22) includes first and second detents (28,30) disposed substantially radially opposite one another about the shaft (18) along a first elevational plane. A third detent (34) is annularly positioned between the first and second detents (28,30) and located along a different elevational plane. The third detent (34) is spaced relatively annularly near one of the first and second detents (28,30), and spaced relatively annularly distant from the other of the first and second detents (28,30). A first cam portion (34) is positioned between the first and third detents (28,34) and has a predetermined slope. A second cam portion (38) is positioned between the second and third detents (30,34) and has a first segment substantially parallel to the elevational planes and a second segment substantially perpendicular to the elevational planes.

9 Claims, 3 Drawing Figures

ELECTRICAL SWITCHING APPARATUS

DESCRIPTION

1. Technical Field

This invention relates generally to an apparatus for switching electrical current.

2. Background Art

Vehicle battery electrical cable terminates are typically connected to battery terminals with bolt-on fasteners. Such fasteners normally require the use of a tool for connecting or disconnecting a cable from a battery terminal.

During the use and servicing of such a vehicle, it is often necessary or convenient to disable the vehicle electrical system by disconnecting all electrical circuits from the battery. For example, it is common practice to disconnect the battery during routine servicing of the vehicle. Such practice ensures that servicing of the vehicle can commence without short circuits occurring, and without inadvertent activation of the vehicle.

It is also advantageous to disconnect the battery when the vehicle is to be left unattended for an extended period of time so as to discourage unauthorized use of the vehicle, and to prevent depletion of the battery due to miscellaneous leakage paths from the battery to the vehicle ground return.

Various methods of disconnecting electrical circuits from a battery on a vehicle have been utilized in the past. For example, U.S. Pat. No. 4,042,759 issued to Alexander Cella on Aug. 16, 1977, discloses a battery cable terminal adapted to be removed from the battery terminal without the use of a tool. U.S. Pat. No. 4,176,284 issued to Edward W. Higgs on Nov. 27, 1979, discloses an electrically operated battery disconnect switch located at a remote location from the battery. A further approach is found in U.S. Pat. No. 4,306,126 issued to Durrell U. Howard on Dec. 15, 1981. Disclosed in this patent is a battery disconnect switch adapted for remote mechanical operation.

The battery disconnect devices described above, as well as others currently available, suffer from a number of significant problems and disadvantages. Devices for removal of a cable terminal connected directly to a battery terminal often become inoperable owing to corrosion on the interface between the battery terminal and the cable terminal. Such corrosion often renders removal of a cable difficult. This is a common problem with lead acid storage batteries.

Connection of electrical circuits to a battery, or disconnection of the electrical circuits from the battery, while current is being drawn from the battery, may produce a spark or electrical arc during such operations. This sparking results in accelerated wear and erosion of the contacting surfaces.

The present invention is directed to overcoming one or more of the problems as set forth above.

DISCLOSURE OF THE INVENTION

In one aspect of the present invention an electrical switching apparatus comprises a housing having one of a cam and follower, a shaft having the other of the cam and follower, a contact movable between first and second positions, and means for moving the contact between the first and second positions.

BRIEF DESCRIPTION OF THE DRAWINGS

For a better understanding of the present invention, reference may be had to the accompanying drawings, in which.

BEST MODE FOR CARRYING OUT THE INVENTION

Figure 1:
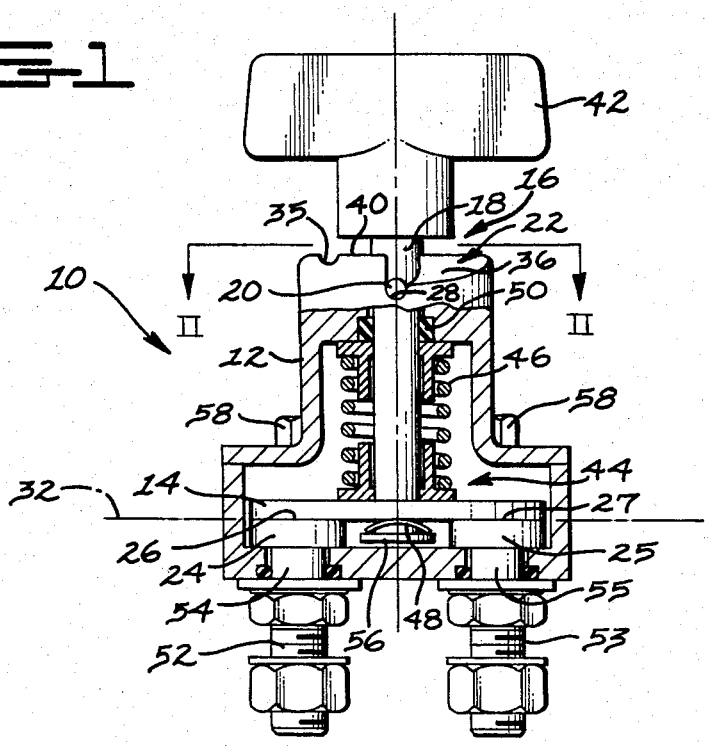
FIG. 1 is a cross-sectional view of an embodiment of the electrical switching apparatus.

An electrical switching apparatus for connecting a battery circuit to or disconnecting a battery circuit from a battery is generally depicted by the reference numeral 10 in FIG. 1. The apparatus 10 includes an electrically non-conductive housing 12 having one of a cam 22 and follower 20, a shaft 18 having the other of the cam 22 and follower 20, an electrically conductive contact 14 movable between first and second operating positions, and a means 16 for moving the contact 14. The housing 12 is preferably of two piece construction for ease of assembly, the two pieces being fastened together by machine screws 58. The means 16 includes the cam 22 and the follower 20 and a resilient member 46, and is adapted for moving the contact 14 from the first position to the second position at a first rate and for moving the contact 14 from the second position to the first position at a second rate, the rates differing substantially one from the other and being controlled by the cam 22. The shaft 18 preferably includes one or more followers 20 and a handler 42, and extends through and is slidable and rotatable relative to the contact 14. The cam 22 is preferably an integral surface portion of the housing 12 wherein any 180° portion of the cam 22 is substantially identical to an opposing 180° portion of the cam 22.

The apparatus 10 also includes multiple spaced apart stationary contacts 24,25 whose contact surfaces 26,27 define a plane. The stationary contacts 24,25 each include a terminal end 52,53, and an intermediate portion 54,55 passing through and in a sealed relationship with the housing 12.

Figure 2:
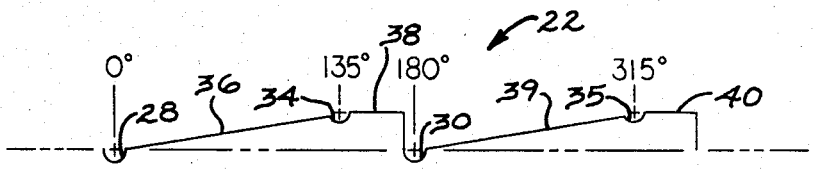
FIG. 2 is a representation of a cam suitable for use in the present invention; and, FIG. 3 is a top view of the embodiment of FIG. 1.
Figure 3:
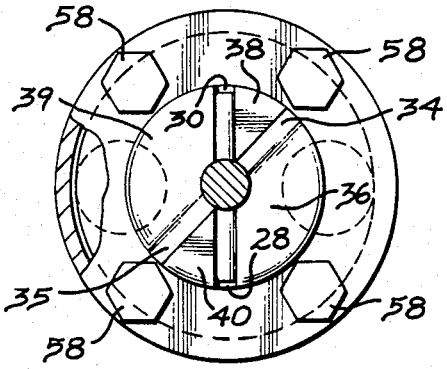

As shown in FIG. 2, the cam 22 includes first and second detents 28,30 located at a first elevation from the plane 32, and a third detent 34 positioned intermediate the first and second detents 28,30 and located at a second elevation from the plane 32. Additionally, the cam 22 includes first and second portions 36,38. The first portion 36 is positioned between the first and third detents 28,34 and has a preselected slope. The second portion 38 is positioned between the second and third detents 30,34 and has a different preselected slope greater than the slope of the first portion 36. In the preferred embodiment best shown in FIG. 3, the first and second detents 28,30 are positioned diametrically opposite one another, and a fourth detent 35 is positioned diametrically opposite the third detent 34. Third and fourth portions 39,40 correspond respectively to the first and second portions 36,38 and the respective corresponding portions are positioned diametrically opposite one another.

Again referring to FIG. 1, the apparatus 10 further includes means 44 for maintaining engagement between the cam 22 and the follower 20. The means 44 includes first and second resilient members 46,48. The first resilient member 46 is preferably a coil spring located about the shaft 18 and functions to bias the contact 14 in a first direction. The second resilient member 48 is preferably a Belleville washer and functions to bias the shaft 18 in the first direction and the contact 14 in a second direction opposite the first direction. Thus, the contact 14 is maintained in slidable and rotatable relationship with the shaft 18 when located between the first and second resilient members 46,48, and the follower 20 is maintained in engagement with the cam 22. The apparatus 10 further includes a seal 50 positioned between the shaft 18 and the housing 12. The first resilient member 46 simultaneously biases the contact 14 in a first direction and the seal 50 in a second direction into sealing engagement with the shaft 18 and the housing 12.

INDUSTRIAL APPLICABILITY

In operation, an electrical switching apparatus 10 is mounted within the engine compartment of a vehicle, for example an earthmoving machine such as a crawler tractor, at a location remote from the vehicle battery and accessible to vehicle operating personnel. The apparatus 10 is placed in series with one of the vehicle battery cables, preferably the cable connected to the chassis or ground side of the vehicle. Connection of the apparatus 10 is accomplished by attaching the cable from the selected battery terminal to one of the terminal end portions 52,53, and the cable from the vehicle chassis to the other of the terminal end portions 52,53. Upon occurrence of a need to disconnect the vehicle battery circuits from the vehicle battery, the shaft 18 is rotated, for example by means of a handle 42, in a direction resulting in movement of the follower 20 from the first detent 28, along the first portion 36, and continuing toward the third detent 34. Since the first portion 36 slopes from the first detent 28 in a direction away from the plane 32 and toward the third detent 34, rotary motion of the shaft 18 is translated by the follower 20 into axial motion of the shaft 18 equal to the change in elevation from the first detent 28 to the third detent 34.

Initial axial motion of the shaft 48 results in compression of the second resilient member 48 and engagement of the shaft end 56 with the contact 14. Further axial motion of the shaft 18 results in the contact 14 moving to a position spaced apart from the contact surfaces 26,27, thereby interrupting electrical continuity between the stationary contacts 24,25 and disconnecting the battery from the battery circuits. The rate of disengagement movement of the contact 14 from the stationary contacts 24,25 is determined by the slope of the first portion 36 and the rate of rotation of the shaft 18. Movement of the contact 14 away from the contact surfaces 26,27 additionally results in compression of the first resilient member 46.

Engagement of the third detent 34 by the follower 20 maintains the apparatus 10 in the battery disconnected mode until such time as it is desired to reconnect the vehicle battery to the battery cable circuits. Continued motion of the follower 20 in a direction from the third detent 34, along the second portion 38, and toward the second detent 30 is again translated by the follower 20 into axial motion of the shaft 18. Since the second portion 38 slopes from the third detent 34 to the second detent 30 in a direction toward the plane 32, the first resilient member 46 urges the contact 14 into bridging engagment with the contact surfaces 26,27, resulting in re-establishment of electrical continuity between the stationary contacts 24,25 and in reconnection of the battery to the battery circuits.

Owing to the large slope of the second portion 38 relative to the first portion 36, the rate of re-engagement of the contact 14 with the stationary contacts 24,25 is substantially faster than the rate of disengagement. Additionally, owing to the bias applied to the contact 14 by the first resilient member 46, once the follower 20 has engaged the second portion 38, re-engagement of the contact 14 with the stationary contacts 24,25 is essentially self completing, with the rate of re-engagement controlled primarily by the spring rate of the first resilient member 46. A brief analysis of typical vehicle servicing procedures will serve to illustrate the need for a rapid contact engagement rate relative to the disengagement rate.

Normally, prior to servicing a vehicle, all electrical devices will be turned off as a matter of course; therefore, minimal current will be demanded from the battery and disconnection of the battery circuits from the battery will not result in significant sparking at the point of disconnection. However, during servicing of the vehicle, various electrical devices may be activated, either purposefully or inadvertently, and may remain in the activated state, unnoticed because of the inavailability of exitation current.

Upon reconnection of the battery to the battery circuits, current demanded by any electrical devices remaining in the activated state will immediately begin to flow at the point of reconnection and cause destructive sparking to occur. Rapid reconnection, as provided by this invention, will minimize such destructive sparking.

With the follower 20 positioned in the first and second detents 28,30, rotation of the shaft 18 in a direction counter to that above described is inhibited by the large slope of the second portion 38.

In order to insure engagement of the contact 14 with the contact surfaces 26,27, and to account for manufacturing tolerances and normal contact wear, some overtravel of the shaft 18 is provided. The first and second detents 28,30 are located at an elevation from the plane 32 less than the distance from the follower 20 to the shaft end 56. Therefore, upon initial engagement of the contact 14 with the contact surfaces 26,27, the follower 20 is not fully engaged with the first and second detents 28,30. The second resilient member 48 is thus free to expand, resulting in sufficient continued axial motion of the shaft 18 to complete engagement of the follower 20 with the first and second detents 28,30. Therefore, overtravel of the shaft 18 is permitted while maintaining engagement between the cam 22 and the follower 20.

Other aspects, objects and advantages of this invention can be obtained from a study of the drawings, the disclosure and the appended claims.

We claim:

1. An electrical switching apparatus (10) comprising:

a housing (12) having a cam (22);

a contact (14) movable between first and second positions within said housing (12);

a shaft (18) having a shaft end (56) and a cam follower (20), said shaft (18) extending through said housing (12) and said movable contact (14) and being slidably and rotatably movable relative to said movable contact (14);

multiple spaced apart stationary contacts (24,25) each having a contact surface (26,27), said stationary contacts (24,25) being positioned within said housing (12), and said contact surfaces (26,27) defining a plane (32);

means (16) for moving said movable contact (14) from said first position to said second position at a first rate and for moving said movable contact (14) from said second position to said first position at a second rate, said rates differing substantially one from the other and being controlled by said cam (22) and follower (20); and wherein said cam (12) includes first and second detents (28,30) disposed substantially radially opposite one another about said shaft (18) along a second plate parallel to and at a first elevational distance from said contact surface defining plane (32);

a third detent (34) annularly positioned between said first and second detents (28,30) and located along a third plane parallel to and at a second elevational distance from said contact surface defining plane (32), said third detent (34) being spaced relatively annularly near one of said first and second detents (28,30), and spaced relatively annularly distant from the other of said first and second detents (28,30); and a first annular cam portion (36) having a predetermined slope and being positioned between said first and third detents (28,34), and a second annular cam portion (38) having a first segment substantially parallel to said contact surface defining plane (32) and a second segment substantially perpendicular to said contact surface defining plane (32), said second cam portion (38) being positioned between said second and third detents (30,34).

2. An electrical switching apparatus (10), as set forth in claim 1, wherein said cam (22) is an integral surface portion of said housing (12).

3. An electrical switching apparatus (10), as set forth in claim 1, wherein any 180° portion of said cam (22) is substantially identical to an opposing 180° portion of said cam (22).

4. An electrical switching apparatus (10), as set forth in claim 1, including a fourth detent (35) positioned diametrically opposite said third detent (34) along said third plane;

a third cam portion (39) substantially identical to said first cam portion (36) and being positioned diametrically opposite said first cam portion (36); and a fourth cam portion (40) substantially identical to said second cam portion (38) and being positioned diametrically opposite said second cam portion (38).

5. An electrical switching apparatus (10), as set forth in claim 1, wherein said second cam portion (38) is adapted to inhibit bidirectional rotation of said shaft (18).

6. An electrical switching apparatus (10), as set forth in claim 1, including a first spring (46) positioned about said shaft (18) between said movable contact (14) and said housing (12), and adapted to bias said movable contact (14) in a first direction, and a second spring (48) positioned about said shaft (18) between said movable contact (14) and said shaft end (56), and adapted to bias said shaft (18) in said first direction and said movable contact (14) in a second direction opposite said first direction.

7. An electrical switching apparatus (10), as set forth in claim 6, including a seal (50) positioned between said shaft (18) and said housing (12).

8. An electrical switching apparatus (10), as set forth in claim 7, wherein said first spring (46) biases said contact (14) in a first direction and said seal (50) in a second direction into sealing engagement with said shaft (18) and said housing (12).

9. A battery disconnect switch (10), comprising:

an electrically non-conductive housing (12) having an exterior cam (22) surface portion;

multiple spaced apart contacts (24,25) each having a contact surface (26,27), a terminal end (52,53), and an intermediate portion (54,55) passing through and in a sealed relationship with said housing (12);

an electrically conductive contact (14) movable at a first predetermined rate from a first position bridging said spaced apart contacts (24,25) to a second position spaced apart from said spaced apart contacts (24,25) and at a second predetermined rate from said second spaced apart position to said first bridging position, said first and second rates being substantially different;

a shaft (18) having a follower (20) and a shaft end (56), said shaft (18) being slidably and rotatably movable relative to said movable contact (14) and passing through and in a sealed relationship with said housing (12);

a first spring (46) positioned about said shaft (18) between said movable contact (14) and said housing (12); and a second spring (48) positioned about said shaft (18) between said shaft end (56) and said movable contact (14).

* * * * *